US006701121B2

(12) United States Patent
Nami et al.

(10) Patent No.: US 6,701,121 B2
(45) **Date of Patent: *Mar. 2, 2004**

(54) COLOR-MIXING FIXING DEVICE IN WHICH IMPACT RESILIENCE OF SURFACE LAYER OF FIXING ROTARY MEMBER IS 50% OR LESS

(75) Inventors: Yasuo Nami, Kawasaki (JP); Takeshi Menjo, Tokyo (JP); Kazuo Kishino, Kawasaki (JP); Jiro Ishizuka, Tokyo (JP); Hideo Kawamoto, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/421,457

(22) Filed: Apr. 13, 1995

(65) Prior Publication Data

US 2002/0039505 A1 Apr. 4, 2002

Related U.S. Application Data

(63) Continuation of application No. 08/276,767, filed on Jul. 18, 1994, now abandoned, which is a continuation of application No. 08/024,160, filed on Feb. 26, 1993, now abandoned.

(30) Foreign Application Priority Data

Mar. 2, 1992 (JP) ..... 4-078771
Oct. 22, 1992 (JP) ..... 4-284571

(51) Int. Cl.[7] ..... G03G 15/20
(52) U.S. Cl. ..... 399/333; 399/328
(58) Field of Search ..... 355/282, 285, 355/289, 290, 295, 319, 326 R, 327; 118/60; 219/216; 399/320, 321, 328, 330, 331, 333, 401

(56) References Cited

U.S. PATENT DOCUMENTS

| | | | | | |
|---|---|---|---|---|---|
| 3,945,726 | A | * | 3/1976 | Ito et al. | 399/331 |
| 4,231,653 | A | * | 11/1980 | Nagahara et al. | 118/60 X |
| 4,258,648 | A | * | 3/1981 | Leising et al. | 118/60 |
| 4,352,551 | A | * | 10/1982 | Iwao | 118/60 X |
| 4,595,274 | A | * | 6/1986 | Sakurai | 219/216 X |
| 4,842,944 | A | * | 6/1989 | Kuge et al. | 355/285 X |
| 4,891,672 | A | * | 1/1990 | Takagi | 355/326 X |
| 5,040,029 | A | * | 8/1991 | Rodenberg et al. | 355/327 X |
| 5,051,780 | A | * | 9/1991 | Stelter et al. | 219/216 X |
| 5,105,217 | A | * | 4/1992 | Igawa | 355/326 X |
| 5,123,151 | A | * | 6/1992 | Uehara et al. | 355/282 X |
| 5,124,756 | A | * | 6/1992 | Stelter | 219/216 X |
| 5,142,339 | A | * | 8/1992 | Kasahara et al. | 355/282 |
| 5,157,445 | A | * | 10/1992 | Shoji et al. | 118/60 X |
| 5,177,552 | A | * | 1/1993 | Isogai et al. | 355/285 |
| 5,352,553 | A | * | 10/1994 | Takeuchi et al. | 430/42 |
| 5,482,760 | A | * | 1/1996 | Takeuchi | 428/195 |

FOREIGN PATENT DOCUMENTS

JP 56-077873 * 6/1981

* cited by examiner

*Primary Examiner*—Sandra Brase
(74) *Attorney, Agent, or Firm*—Robin, Blecker & Daley

(57) ABSTRACT

A color-mixing fixing device includes a first fixing rotary member, and a second fixing rotary member for forming a nip together with the first fixing rotary member. After toner images of a plurality of colors stacked on one surface of a recording medium are fixed by a nip, toner images of a plurality of colors stacked on the other surface of the recording medium are fixed by the nip, thereby forming full-color images on both the surfaces of the recording medium. Each of the first and second fixing rotary members has a surface rubber layer with an impact resilience of 50% or less.

4 Claims, 5 Drawing Sheets

COLOR-MIXING FIXING DEVICE IN WHICH IMPACT RESILIENCE OF SURFACE LAYER OF FIXING ROTARY MEMBER IS 50% OR LESS

This is a continuation application under 37 CFR 1.62 of prior application Ser. No. 08/024,160, filed Feb. 26, 1993 now abandoned.

This is a continuation application under 37 CFR 1.62 of prior application Ser. No. 08/276,767, filed Jul. 18, 1994 now abandoned.

BACKGROUND OF THE INVENTION

1. Field of the Invention

The present invention relates to a fixing device for use in an image forming apparatus, such as a copying machine and a printer, and, more particularly, to a fixing device for use in an image forming apparatus capable of forming full-color images on both surfaces of a recording medium.

2. Related Background Art

A heat roller system has been widely used as a fixing device, in which fixing is performed for a recording medium that carries an unfixed image by clamping and conveying the medium between a pair of rotary members, at least one of which is heated.

In this heat roller system, a rubber layer consisting of, e.g., silicone rubber is formed on one of the rotary members in order to obtain a predetermined nip width.

It is considered preferable to use rubber having a high impact resilience as the rubber for this rotary member of a fixing device because such rubber is excellent in conveyance properties. For this reason, this sort of rubber is used in many black-and-white image forming apparatuses.

In full-color image forming apparatuses, on the other hand, it is preferable to use rubber layers on both fixing rollers of the roller pair because, in these apparatuses, multiple toner layers are formed and so the total thickness of toner layers is large.

In formation of full-color images on both surfaces of a recording medium, however, the use of high-impact-resilience rubber encounters the following problems.

An unfixed toner image of full color is formed by multiple layers of several color toners, and so the layer thickness of a fixed image is larger than that of a black-and-white image. Therefore, when a recording medium enters the nip portion in order to perform fixing of the second surface, the unevenness of the image already fixed on the first surface causes slight changes in angle and rate of entering and vibrations of the recording medium, thus disturbing the image on the second surface. In addition, since a full-color image consists of multiple layers as described above, formation of full-color images requires a larger heating amount than that for black-and-white images. Furthermore, in order to improve color mixing properties, a toner having good melt properties is used as a color toner. This increases the coating amount of a release agent for preventing offset with respect to the rotary members compared to those in apparatuses for black-and-white images. In the fixing device of a full-color image forming apparatus, therefore, there is a possibility that the surfaces of the rotary members deform under the influences of, e.g., long-term heating and a release agent, and the disturbance in an image described above becomes significant due to the deformation. That is, the fixing device of a full-color image forming apparatus is unsuitable for a long-term operation although the qualities of images are good in early stages.

SUMMARY OF THE INVENTION

It is an object of the present invention to provide a color-mixing fixing device capable of forming full-color images on both surfaces of a recording medium.

It is another object of the present invention to provide a color-mixing fixing device which does not disturb an image in color mixing on the second one of the two surfaces.

It is still another object of the present invention to provide a color-mixing fixing device in which the impact resilience of a rubber layer on the surface of each of a pair of fixing rotary members is 50% or less.

Other objects of the present invention will become apparent in the following description.

DESCRIPTION OF THE PREFERRED EMBODIMENTS

Figure 4:
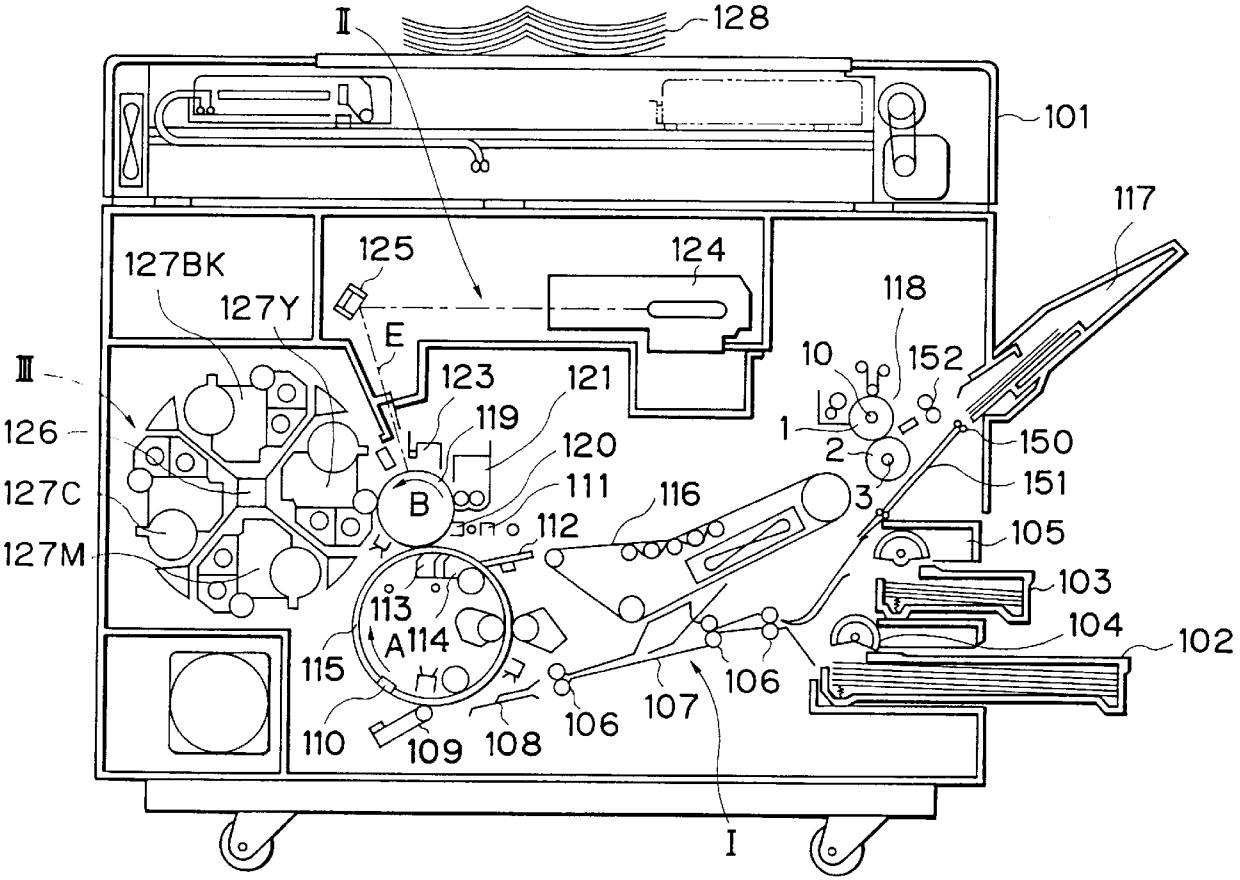
FIG. 4 is a sectional view showing an image forming apparatus using the fixing devices of the embodiments of the present invention.

FIG. 4 is a sectional view showing an image forming apparatus using fixing devices according embodiments of the present invention, which can form full-color images on both surfaces of a recording medium.

This image forming apparatus can be roughly divided into three sections: a transfer medium conveying system I arranged from the right-hand side (the right-hand side of FIG. 4) of an apparatus main body 101 to a substantially central portion of the apparatus main body; a latent image forming section II arranged in substantially the central portion of the apparatus main body 101 and in the vicinity of a transfer drum 115 that constitutes the transfer medium conveying system I; and a developing means, i.e., a rotary developing unit III disposed near the latent image forming section II.

The transfer medium conveying system I has the following arrangement. Opening portions are formed in the right-hand wall (the right-hand side of FIG. 4) of the apparatus main body 1. Detachable transfer medium supply trays 102 and 103 are inserted into these opening portions so as to partially project outside the apparatus. Paper supply rollers 104 and 105 are disposed substantially immediately above these trays 102 and 103, respectively. Paper feed rollers 106 and paper guides 107 and 108 are arranged to connect the paper supply rollers 104 and 105 with the transfer drum 115. The transfer drum 115 is a transfer means arranged on the left-hand side of the apparatus and rotatable in a direction indicated by an arrow A. In the vicinity of the outer circumferential surface of the transfer drum 115, a stop roller 109, a gripper 110, a transfer medium separating charger 111, and a separating claw 112 are arranged in sequence from the upstream side to the downstream side in the direction of rotation. In addition, a transfer charger 113 and a transfer medium separating charger 114 are disposed on the side of the inner circumferential surface of the transfer drum 115. A transfer sheet (not shown) consisting of polyvinylidene fluoride or the like is pasted on a portion of the transfer drum 115 on which a transfer medium is to be wound. A transfer medium is in electrostatically tight contact with the transfer sheet. A conveyor belt means 116 is located above and on the right-hand side of the transfer drum 115, in the vicinity of the separating claw 112. A fixing device 118 is arranged at the terminal (right-hand) end in the direction of conveyance of a transfer medium of the conveyor belt means 116. On the downstream side in the conveyance direction farther from the fixing device 118, a paper delivery tray 117 detachable with respect to the apparatus main body 101 is disposed to extend outside the apparatus main body 101.

The arrangement of the latent image forming section II will be described below. A photoconductor drum 119 as a latent image carrier rotatable in a direction indicated by an arrow B in FIG. 4 is arranged with its outer circumferential surface in contact with the outer circumferential surface of the transfer drum 115. In a portion above the photoconductor drum 119 and close to the outer circumferential surface of the drum 119, a charge removal charger 120, a cleaning means 121, and a primary charger 123 are arranged in sequence from the upstream side to the downstream side in the direction of rotation of the photoconductor drum 119. In addition, in order to form an electrostatic latent image on the outer circumferential surface of the photoconductor drum 119, an image exposing means 124, such as a laser beam scanner, and an image-exposure reflecting means 125, such as a mirror, are also provided.

The arrangement of the rotary developing unit III is as follows. A rotatable housing (to be referred to as a "rotary member" hereinafter) 126 is disposed at a position opposing the outer circumferential surface of the photoconductor drum 119. Four types of developing devices are arranged in the rotary member 126 at four positions in the circumferential direction of the rotary member 126. These developing devices visualize (i.e., develop) an electrostatic latent image formed on the outer circumferential surface of the photoconductor drum 119. The four developing devices are a yellow developing device 127Y, a magenta developing device 127M, a cyan developing device 127C, and a black developing device 127BK.

The sequence of the whole image forming apparatus with the above arrangement will be briefly described below by taking an operation of a full-color mode as an example. When the photoconductor drum 119 rotates in the direction of the arrow B in FIG. 4, a photoconductor on the drum 119 is uniformly charged by the primary charger 123. In the apparatus of FIG. 4, the operating speed (to be referred to as a process speed hereinafter) of each component is 160 mm/sec. After the primary charger 123 uniformly charges the photoconductor, image exposure is performed by a laser beam E modulated by a yellow image signal of an original 128, thereby forming an electrostatic latent image on the photoconductor drum 119. This electrostatic latent image is developed by the yellow developing device 127Y already located at a developing position by the rotation of the rotary member 126.

A transfer medium that has been conveyed through the paper guide 107, the paper feed roller 106 and the other paper guide 108, is gripped by the gripper 110 at a predetermined timing and electrostatically wound on the transfer drum 115 by the stop roller 109 and an electrode arranged to oppose the stop roller 109. Since the transfer drum 115 rotates in the direction of the arrow A in FIG. 4 in synchronism with the photoconductor drum 119, the image developed by the yellow developing device 127Y is transferred by the transfer charger 113 at the contact portion between the outer circumferential surfaces of the photoconductor drum 119 and the transfer drum 115. The transfer drum 115 continues rotating to prepare for transfer of the next color (magenta in FIG. 4).

The photoconductor drum 119, on the other hand, is discharged by the charge removal charger 120 and cleaned by the cleaning means 121 making use of a conventional blade process. Thereafter, the photoconductor drum 119 is charged again by the primary charger 123 and subjected to the image exposure as described above by a magenta image signal as the next signal. While an electrostatic latent image is formed by the magenta image signal on the photoconductor drum 119 during the image exposure, the rotary developing unit rotates to set the magenta developing device 127M at the predetermined developing position described above, performing predetermined magenta development. Subsequently, the above process is executed for each of cyan and black colors to complete transfer of the four colors. The four-color image formed on the transfer medium is charge-removed by the chargers 120 and 114, and the transfer medium is released from gripping by the gripper 110 and separated from the transfer drum 115 by the separating claw 112. The separated transfer medium is conveyed to the fixing device 118 by the conveyor belt 116, and the image is fixed by heat and pressure, thereby completing the whole full-color print sequence. The transfer medium is delivered by paper delivery rollers 152, and a predetermined full-color print image is obtained.

A toner used in this image forming apparatus will be described below.

Since this full-color toner is required to be excellent in melt properties and color mixing properties when applied with heat, a sharp-melt toner having a low softening point and a low melt viscosity is used. The use of this sharp-melt toner widens the range of color reproducibility of copied products, making it possible to obtain high-fidelity color copies of a multi-color or full-color image of an original.

The sharp-melt toner is manufactured by melt-kneading, grinding, and classifying toner forming materials, e.g., a binder resin such as a polyester resin or a styrene-acrylester resin, a coloring agent (a dye or subliming dye), and a charge control agent. If necessary, an addition step of adding various additives (e.g., hydrophobic colloidal silica) to the toner may also be performed. As such color toner, a toner using a polyester resin as the binder resin is particularly preferable when fixing properties and sharp-melt properties are taken into account. An example of the sharp-melt polyester resin is a polymer compound synthesized from a diol compound and carboxylic acid and having an ester bond on a main chain of a molecule.

A more preferable example is a polyester resin obtained by co-condensation polymerization of a bisphenol derivative represented by:

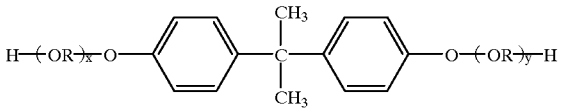

(wherein R represents an ethylene or propylene group, each of x and y represents a positive integer of 1 or more, and an average value of x+y is 2 to 10) or its substituent, as a diol component, and a carboxylic acid component (e.g., fumaric acid, maleic acid, maleic anhydride, phthalic acid, terephthalic acid, trimellitic acid, and pyromellitic acid) consisting of any of carboxylic acids having valences of 2 or more, acid anhydrides thereof, and lower alkylesters thereof. This polyester resin is preferable because of its sharp melt characteristics.

The softening point of the polyester resin is 75 to 150° C., preferably 80 to 120° C.

Figure 5:
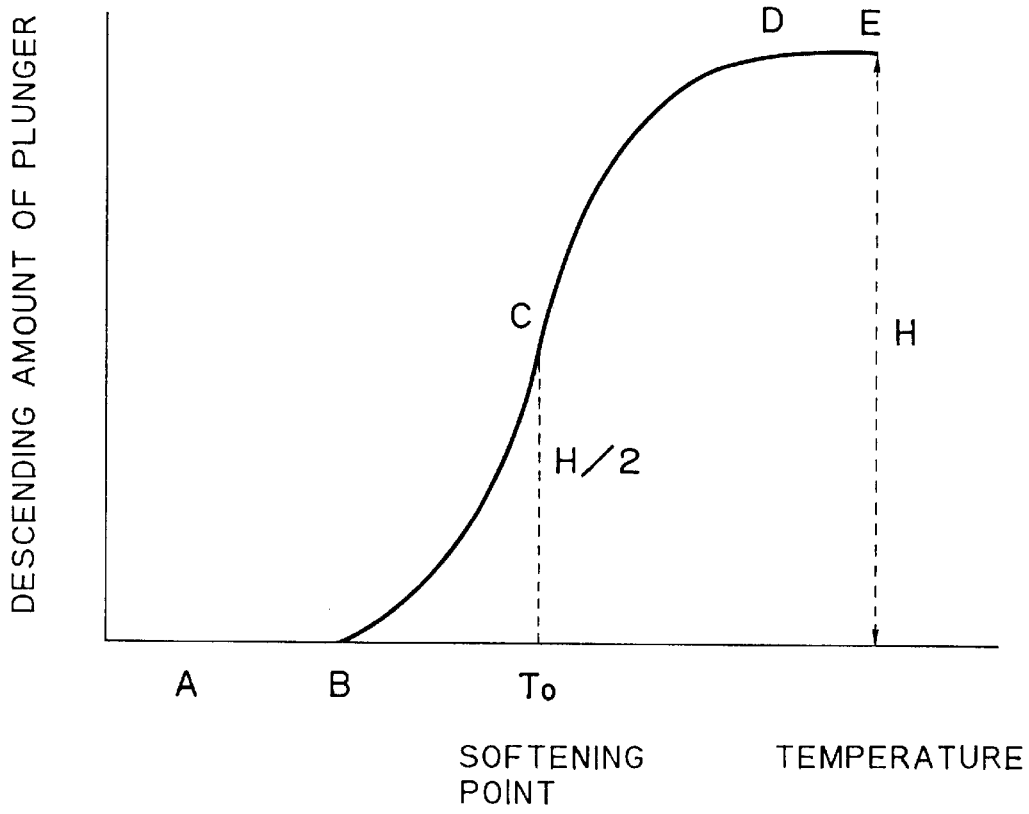
FIG. 5 is a graph for explaining the physical properties of a toner used in the embodiments of the present invention.

FIG. 5 shows the softening characteristics of a sharp-melt toner containing this polyester resin as the binder resin. The measurement conditions were as follows.

A flow tester CFT-500A (available from Shimazu Corp.) was used, and an extrusion load of 20 kg was applied using a die (nozzle) 0.2 mm in diameter and 1.0 mm in thickness. After a preheating time of 300 seconds at an initial temperature of 70° C., the temperature was raised at a uniform rate of 6° C./min. to obtain a descending amount of plunger-temperature curve (to be referred to as a softening S curve hereinafter) of the toner. In this case, 1 to 3 g of a fine powder were precisely weighed to be used as the sample toner, and the sectional area of the plunger was set at 1.0 $cm^2$. The softening S curve was as shown in FIG. 5. As the temperature was raised at the uniform rate, the toner was gradually heated to start flowing (descending of plunger A→B). When the temperature was further raised, the toner in a molten state largely flowed (B→C→D), and the descending of the plunger then stopped (D→E).

A height H of the S curve indicates the total flow amount, and a temperature T0 corresponding to a point C at H/2 indicates the softening point of the toner.

Whether a toner and a binder resin have sharp-melt properties can be checked by measuring an apparent melt viscosity of the toner or the binder resin.

A toner or a binder resin possessing sharp-melt properties is defined as one satisfying the following relations, assuming that a temperature at which an apparent melt viscosity indicates $10^3$ poise is T1 and a temperature at which it indicates $5\times10^2$ poise is T2:

$$T1=90 \text{ to } 150^\circ \text{ C.}$$

$$|\Delta T|=|T1-T2|=5 \text{ to } 20^\circ \text{ C.}$$

The characteristic feature of a sharp-melt resin having the above temperature-melt viscosity characteristics is that the resin causes an extremely sharp reduction in viscosity when heated. This reduction in viscosity brings about appropriate mixing of the uppermost toner layer and the lowermost toner layer and abruptly increases the transparency of each toner layer itself, causing good subtractive mixing.

A double-side copying operation will be described below.

The image forming apparatus also includes paper resupply rollers 150 and a conveyance passage 151 for resupplying paper.

A transfer medium, which is developed in the developing unit III and carries an unfixed toner image on its surface, is conveyed by the conveyor belt means 116, and the image is fixed by a fixing roller 129 and a pressure roller 130. Thereafter, the transfer medium is delivered to the paper delivery tray 117 by the paper delivery rollers 152.

The transfer medium thus delivered is manually inserted into a manual insertion port and resupplied by the paper resupply rollers 150. The-transfer medium is conveyed again to the latent image forming section II through the conveyance passage 151, and a color image is formed on the lower surface of the medium in the same manner as for the upper surface. The transfer medium that carries the fixed color image on its upper surface and an unfixed color toner image transferred to its lower surface is conveyed to the fixing roller 129 and the pressure roller 130 by the conveyor belt means 116 and subjected to fixing. Finally, the transfer medium is delivered to the paper delivery tray 117, thereby completing the double-side color copying.

The fixing device of this embodiment will be described below.

Figure 1:
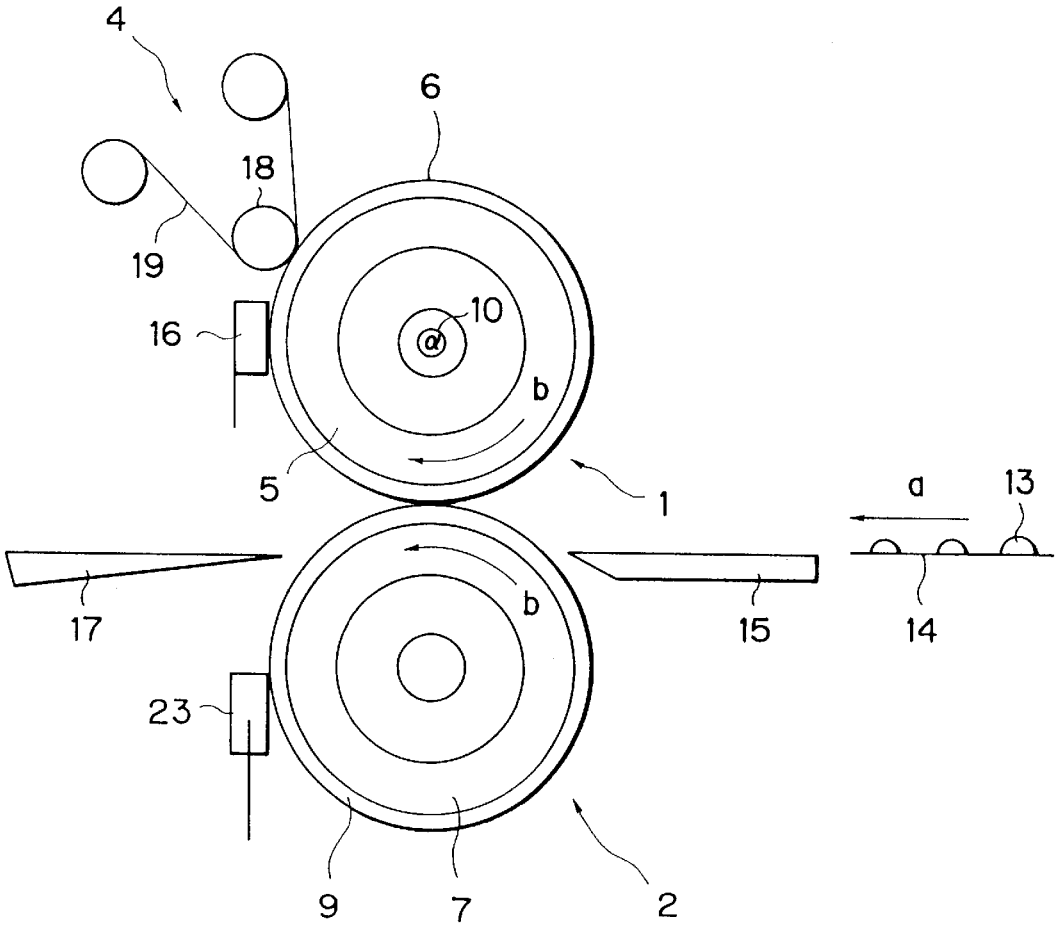
FIG. 1 is a sectional view showing a schematic arrangement of a device according to the first embodiment of the present invention.

Referring to FIG. 1, a fixing roller 1 is formed by coating 2-mm thick addition silicone rubber 6 according to the present invention on the outer circumferential surface of an aluminum mandrel 5. A pressure roller 2 is arranged below the fixing roller 1. The pressure roller 2 is formed by coating a 1-mm thick layer of addition silicone rubber 9 according to the present invention on the outer circumferential surface of an aluminum mandrel 7. These two rollers are urged against each other and rotated in a direction indicated by an arrow b in FIG. 1 by a driving means (not shown). A halogen heater 10 as a heating source is arranged inside the fixing roller 1. A control means (not shown) senses the temperature of the fixing roller 1 by using a thermistor 16 in contact with the fixing roller 1, and controls intermittent power supply to the halogen heater 10. In this manner, the temperature of the fixing roller 1 is kept at a predetermined temperature (170° C.) suitable for fixing an unfixed toner image 13 on a recording medium 14. In addition, a cleaning unit 4 for removing toner that is offset to the surface of the fixing roller 1 is arranged above the fixing roller 1. A press roller 18 of the cleaning unit 4 brings a nonwoven fabric 19 into contact with the surface of the fixing roller 1.

In the fixing device of this embodiment with the above arrangement, the recording medium 14 carrying the unfixed toner image 13 is conveyed in a direction indicated by an arrow a in FIG. 1 by a conveyor means (not shown) and inserted into a tight-contact portion (to be referred to as a nip portion hereinafter) between the fixing roller 1 and the pressure roller 2 that are rotated in the direction of the arrow b in FIG. 1. The unfixed toner image 13 carried by the recording medium 14 is fixed on it by heat that is supplied from the halogen heater 10 via the fixing roller 1 and controlled at a predetermined temperature.

The compositions of the toners used in this embodiment are as follows.

| | |
|---|---|
| 1. Magenta toner | |
| Pigment C. I. Solvent red 49 | 4 parts by weight |
| Dye C. I. Pigment red 122 | 0.7 parts by weight |
| Charge control agent | 4 parts by weight |
| Additives | |
| with respect to 100 parts by weight of a polyester-based main binder. | |
| 2. Cyan toner | |
| Phthalocyanine pigment | 5 parts by weight |
| Charge control agent | 4 parts by weight |
| Additives | |
| with respect to 100 parts by weight of a polyester-based main binder. | |
| 3. Yellow toner | |
| C. I. Pigment yellow 17 | 5 parts by weight |
| Charge control agent | 4 parts by weight |
| Additives | |
| with respect to 100 parts by weight of a polyester-based main binder. | |
| 4. Black toner | |
| Carbon black | 5 parts by weight |
| with respect to 100 parts by weight of a polyester-based main binder. | |

In this embodiment, a full-color image is formed by mixing the above color toners. Therefore, since the thickness of the toner layers on a recording medium is large, an image disturbance occurs if the impact resiliences of the surface layers of the fixing roller 1 and the pressure roller 2 are too high.

This embodiment uses addition silicone rubber that consists of 40 parts by weight of an end-vinyl-hindered straight-chain dimethylpolysiloxane with a viscosity of 100,000 poise and 60 parts by weight of resinous organopolysiloxane, as a ladder polymer, and has an impact resilience of 40%, for both the fixing and pressure rollers.

The comparison test conducted for the rollers of this embodiment and rollers having different impact resiliences will be described below. The rollers used as objects of comparison were: a roller pair ① in which the impact resiliences of both fixing and pressure rollers were 70%; a roller pair ② in which the impact resiliences of both fixing and pressure rollers were 60%; a roller pair ③ in which the impact resilience of a fixing roller was 70% and that of a pressure roller was 40%; and a roller pair ④ in which the impact resilience of a fixing roller was 60% and that of a pressure roller was 40%. These roller pairs were compared by a durability test of forming full-color images on both surfaces of a recording medium. Note that all the rollers had the same deformation characteristic on the roller surfaces. The rotational speed of each of the fixing and pressure rollers was 90 mm/sec.

Results of Test

Roller pair ① (the impact resiliences of both the rollers were 70%)

Image disturbance was found from the beginning.

Roller pair ② (the impact resiliences of both the rollers were 60%)

Image disturbance occurred upon making 5,000 copies.

Roller pair ③ (the combination of 70% and 40%)

Image disturbance occurred upon making 10,000 copies.

Roller pair ④ (the combination of 60% and 40%)

Image disturbance occurred upon making 20,000 copies.

Roller pair of the present invention (the impact resiliences of both the rollers were 40%)

No image disturbance was found even upon making 50,000 copies.

As is apparent from the above test results, the embodiment of the present invention could form good images free from image disturbance. The test was also conducted under the same conditions using several different impact resiliences. As a result, it was found that occurrence of image disturbance could be prevented over long periods of time if the impact resiliences of both the fixing and pressure rollers were 50% or less.

If, however, the impact resiliences were too low, large deformation occurred within a short time period, and consequently gloss variations were caused in images by deformation on the roller surfaces or conveyance of recording media became unstable.

The following is the test result of a roller pair ⑤ in which the impact resiliences of both the rollers were 29%.

Roller pair ⑤ (the impact resiliences of both the rollers were 29%)

Gloss variations were caused by an initial roller deformation, although no image disturbance was found even upon making 50,000 copies.

For this reason, it is more preferable to set the impact resilience at 30% or more.

Figure 2:
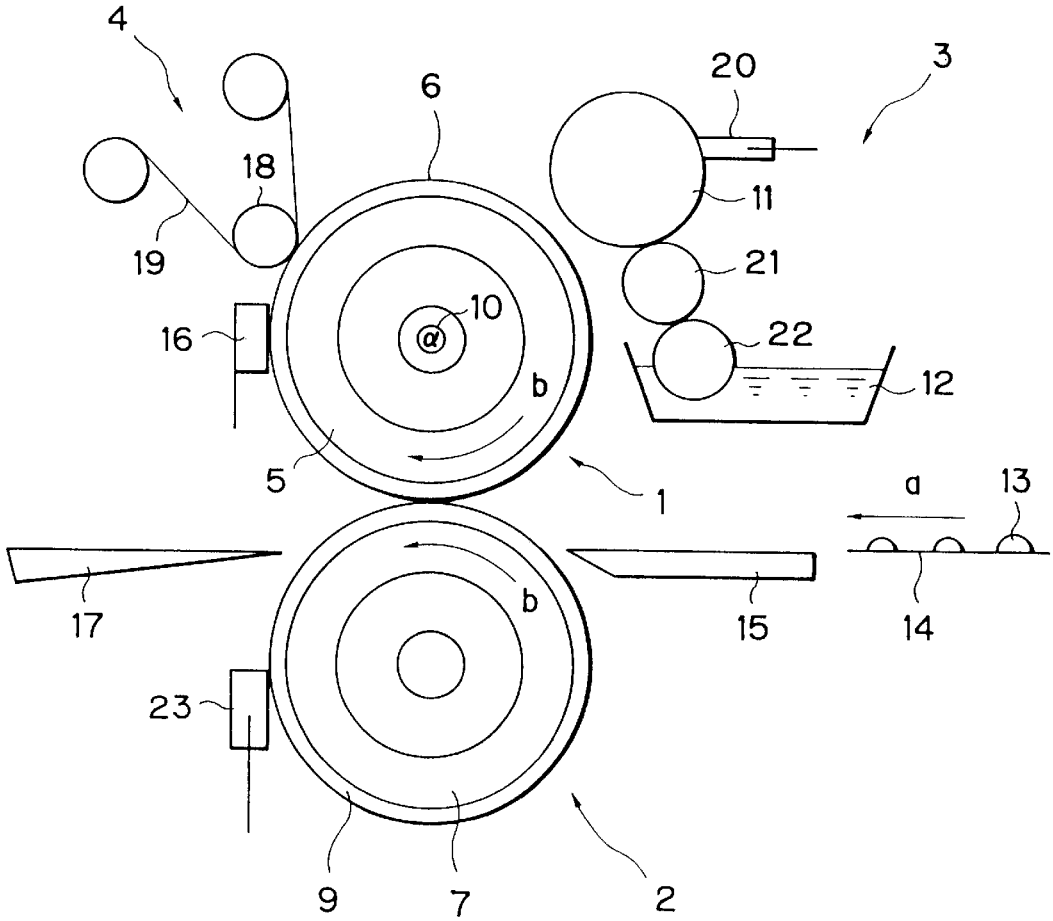
FIG. 2 is a sectional view showing a schematic arrangement of a device according to the second embodiment of the present invention.

FIG. 2 shows a fixing device according to another embodiment of the present invention.

Note that the same reference numerals as in the first embodiment denote the same parts in this second embodiment and a detailed description thereof will be omitted.

A fixing roller 1 of this embodiment is equipped with a release agent coating unit 3 located at a predetermined position of the fixing device in order to improve the release properties of the toners with respect to the surface of the fixing roller. This release agent coating unit 3 feeds silicone oil 12 contained in an oil tank up to a release agent coating roller 11 via feed rollers 21 and 22 and coats the silicone oil 12 on the fixing roller 1 while controlling the coating amount by using a blade 20. The release agent coating unit 3 can move away from and close to the fixing roller 1. In this embodiment, the release agent coating is started when a recording medium 14 moves to a position 1 cm before the nip and continued until the trailing end of the recording medium 14 moves 1 cm away from the nip. The other arrangement is the same as the first embodiment. The rotational speed of each of the fixing and pressure rollers is also the same as in the first embodiment, 90 mm/sec.

When the same test as in the first embodiment was conducted in this embodiment, the degree of deformation became larger than that in the first embodiment owing to the use of silicone oil, and consequently the results of the individual roller pairs also became worse than those in the first embodiment. Note that the degrees of deformation of the individual rollers, including those of this embodiment, were about the same in the test.

As described above, the results of the roller pairs ① to ④ were worse than those in the first embodiment, but the roller pair of this embodiment could achieve the same result free from image disturbance as in the first embodiment.

The test result of the roller pair ⑤ in which the impact resiliences of both the rollers were 29% was as follows.

Roller pair ⑤ (the impact resiliences of both the rollers were 29%)

Gloss variations were caused by an initial roller deformation, although no image disturbance was found even upon making 50,000 copies.

Figure 3:
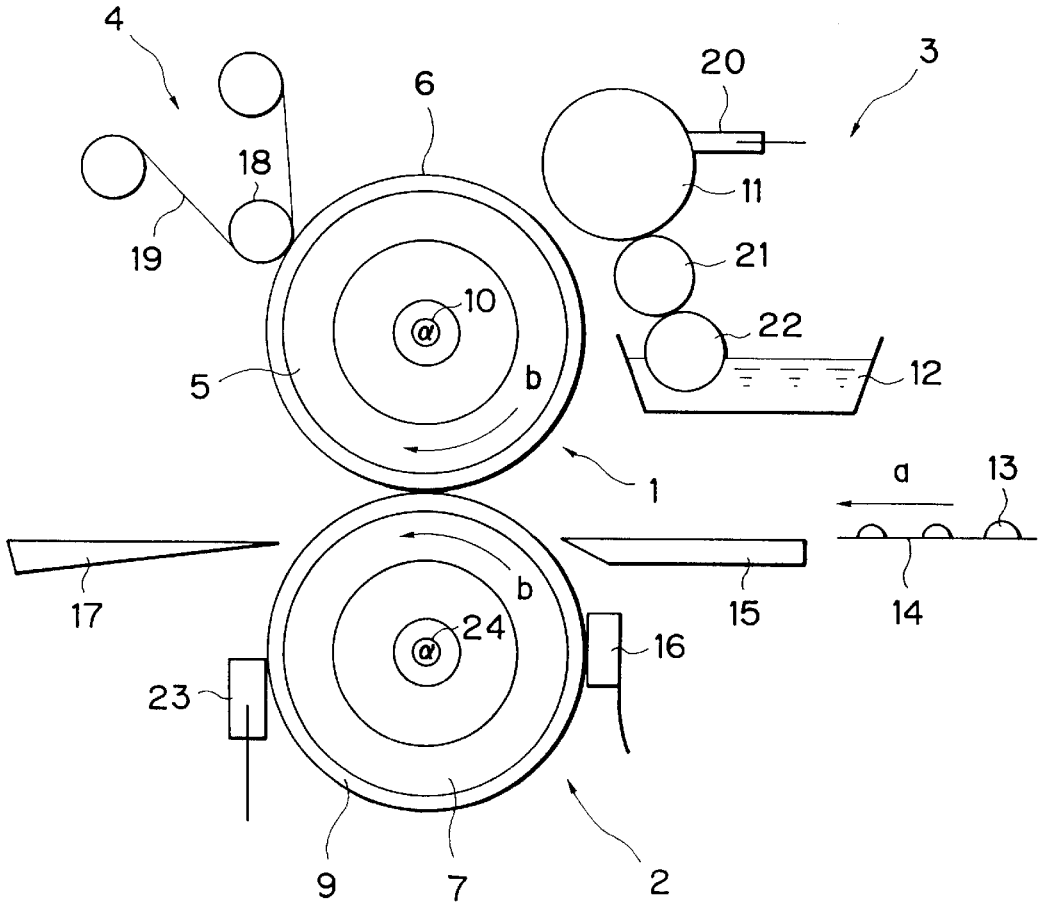
FIG. 3 is a sectional view showing a schematic arrangement of a device according to the third embodiment of the present invention.

FIG. 3 shows a fixing device according to still another embodiment of the present invention.

This embodiment is different from the above second embodiment in that a pressure roller 2 also includes a heater 24 and a thermistor 16 is brought into contact with the pressure roller 2, and that the rotational speed of each of the fixing and pressure rollers is set at 120 mm/sec. The same test as in the second embodiment was also conducted in this embodiment.

In this embodiment, in order to check the influence of a difference in impact resilience, a comparison test was conducted by using addition silicone rubber that consisted of 20 parts by weight of end-vinyl-hindered straight-chain dimethylpolysiloxane with a viscosity of 100,000 poise and 80 parts by weight of resinous organopolysiloxane, as a ladder polymer, and had an impact resilience of 46%.

The comparison test of the rollers of this embodiment and the rollers having different impact resiliences will be described below. The rollers used as objects of comparison were: a roller pair ① in which the impact resiliences of both fixing and pressure rollers were 70%; a roller pair ② in which the impact resiliences of both fixing and pressure rollers were 60%; a roller pair ③ in which the impact resilience of a fixing roller was 70% and that of a pressure roller was 40%; and a roller pair ④ in which the impact resilience of a fixing roller was 60% and that of a pressure roller was 40%. These roller pairs were compared by a durability test of forming full-color images on both surfaces of a recording medium. Note that all the rollers had the same deformation characteristic on the roller surfaces. Note also that the rotational speed of each of the fixing and pressure rollers was 90 mm/sec.

Results of Test

Roller pair ①(the impact resiliences of both the rollers were 70%)

Image disturbance was found from the beginning.

Roller pair ② (the impact resiliences of both the rollers were 60%)

Image disturbance occurred upon making 4,000 copies.

Roller pair ③ (the combination of 70% and 40%)

Image disturbance occurred upon making 8,000 copies.

Roller pair ④ (the combination of 60% and 40%)

Image disturbance occurred upon making 14,000 copies.

Roller pair of the present invention (the impact resiliences of both the rollers were 40%)

No image disturbance was found even upon making 50,000 copies.

Roller pair of the present invention (the impact resiliences of both the rollers were 29%)

No image disturbance was found even upon making 50,000 copies, but gloss variations were caused by an initial roller deformation.

Roller pair of the present invention (the combination of 40% and 60%)

High-quality images free from image disturbance could be obtained even upon making 50,000 copies, but the direction of delivery from the nip was unstable.

As can be seen from the above test results, image disturbance can be prevented by setting the impact resiliences of the elastic layers on the surfaces of both the rollers at 50% or less. If, however, the difference in impact resilience is too large, the direction of delivery of recording media from the nip becomes unstable, and so paper jam becomes more easy to occur.

For this reason, the difference in impact resilience between the surface elastic layers is preferably 5% or less, and most preferably 3% or less.

Note that each of the above embodiments uses a roller obtained by forming a surface elastic layer on a mandrel, but the present invention is also applicable to a roller with a multi-layer arrangement.

That is, since a layer that has an influence on image disturbance is the surface layer, the impact resilience of the surface layer of each roller of a roller pair need only be set at 50% or less even in the case of the multi-layer arrangement.

Note that the measurement of impact resilience follows JIS K 6301.

Although the embodiments of the present invention have been described above, the present invention is not limited to these embodiments but can be variously modified without departing from the spirit and scope of the invention.

What is claimed is:

1. A color-mixing fixing device comprising:

a first fixing rotary member have a surface silicone rubber layer and contacting with an unfixed image; and a second fixing rotary member have a surface silicone rubber layer for forming a nip together with said first fixing rotary member, wherein after toner images of a plurality of colors stacked on one surface of a recording medium are fixed at a nip, toner images of a plurality of colors stacked on the other surface of the recording medium are fixed at the nip, thereby forming full-color images on both the surfaces of the recording medium, wherein each of the surface silicone rubber layer of said first and second fixing rotary members has an impact resilience of not more than 50% and a difference in the impact resilience between said surface rubber layers of said first and second fixing rotary members is within 5%, and wherein the surface silicone rubber layer of said first fixing rotary member is thicker than that of the surface silicone rubber layer of said second fixing rotary member.

2. A device according to claim 1, wherein the impact resilience of said surface rubber layer of each of said first and second fixing rotary members is not less than 30%.

3. A device according to claim 1, wherein the difference in impact resilience between said surface rubber layers of said first and second fixing rotary members is within 3%.

4. A device according to claim 1, wherein both of said first and second fixing rotary members include internal heat sources.

* * * * *

UNITED STATES PATENT AND TRADEMARK OFFICE

CERTIFICATE OF CORRECTION

PATENT NO. : 6,701,121 B2
DATED : March 2, 2004
INVENTOR(S) : Yasuo Nami et al.

It is certified that error appears in the above-identified patent and that said Letters Patent is hereby corrected as shown below:

Column 10,
Line 25, delete “at a nip” and insert -- at the nip --.

Signed and Sealed this

Twenty-eighth Day of February, 2006

JON W. DUDAS
*Director of the United States Patent and Trademark Office*